US010622182B2

(12) United States Patent
Eberhardt et al.

(10) Patent No.: US 10,622,182 B2
(45) Date of Patent: Apr. 14, 2020

(54) X-RAY ANODE

(71) Applicant: PLANSEE SE, Reutte (AT)

(72) Inventors: Nico Eberhardt, Pflach (AT); Wolfram Knabl, Reutte (AT); Stefan Schoenauer, Pflach (AT); Andreas Wucherpfennig, Reutte (AT)

(73) Assignee: Plansee SE, Reutte (AT)

( * ) Notice: Subject to any disclaimer, the term of this patent is extended or adjusted under 35 U.S.C. 154(b) by 130 days.

(21) Appl. No.: 15/572,240

(22) PCT Filed: May 2, 2016

(86) PCT No.: PCT/AT2016/000050
§ 371 (c)(1),
(2) Date: Nov. 7, 2017

(87) PCT Pub. No.: WO2016/179615
PCT Pub. Date: Nov. 17, 2016

(65) Prior Publication Data

US 2018/0130631 A1 May 10, 2018

(30) Foreign Application Priority Data

May 8, 2015 (AT) ..... GM113/2015 U

(51) Int. Cl.
*H01J 35/08* (2006.01)
*H01J 35/10* (2006.01)

(52) U.S. Cl.
CPC ..... *H01J 35/08* (2013.01); *H01J 35/10* (2013.01); *H01J 2235/084* (2013.01); *H01J 2235/088* (2013.01)

(58) Field of Classification Search
CPC ..... H01J 35/10; H01J 2235/084; H01J 2235/088; H01J 35/08
See application file for complete search history.

(56) References Cited

U.S. PATENT DOCUMENTS

| | | | |
|---|---|---|---|
| 2,863,083 | A | 12/1958 | Schram |
| 4,352,041 | A | 9/1982 | Huebner et al. |
| 5,204,891 | A | 4/1993 | Woodruff et al. |
| 6,385,295 | B1 | 5/2002 | Van De Vorst et al. |
| 6,463,123 | B1 | 10/2002 | Korenev |
| 7,203,283 | B1 | 4/2007 | Puusaari |
| 7,349,525 | B2 | 3/2008 | Morton et al. |
| 8,208,603 | B2 | 6/2012 | Sato |
| 9,269,525 | B2 | 2/2016 | Mueller et al. |
| 9,449,780 | B2 | 9/2016 | Chen |

(Continued)

FOREIGN PATENT DOCUMENTS

| | | | |
|---|---|---|---|
| CN | 103945971 | A | 7/2014 |
| CN | 104350574 | A | 2/2015 |

(Continued)

*Primary Examiner* — David P Porta
*Assistant Examiner* — Fani Boosalis
(74) *Attorney, Agent, or Firm* — Laurence A. Greenberg; Werner H. Stemer; Ralph E. Locher

(57) ABSTRACT

An x-ray anode for generating x-radiation includes a carrier body and a first emission layer and at least one second emission layer, which generate x-radiation when they are impinged by electrons. The emission layers are separated by an intermediate layer on one side of the carrier body and are arranged a distance apart in a central direction of the x-ray anode.

15 Claims, 6 Drawing Sheets

(56) References Cited

U.S. PATENT DOCUMENTS

| | | | | |
|---|---|---|---|---|
| 9,564,284 | B2 | 2/2017 | Gerzoskovitz et al. | |
| 2003/0185344 | A1 | 10/2003 | Ukita | |
| 2015/0092924 | A1* | 4/2015 | Yun ..... | H01J 35/12 378/143 |
| 2016/0064175 | A1 | 3/2016 | Yun et al. | |

FOREIGN PATENT DOCUMENTS

| | | | |
|---|---|---|---|
| DE | 2415578 | A1 | 10/1974 |
| DE | 102005049519 | A1 | 8/2006 |
| EP | 0023065 | A1 | 1/1981 |
| JP | S5618356 | A | 2/1981 |
| JP | 2001319605 | A | 11/2001 |
| JP | 2003142000 | A | 5/2003 |
| JP | 2011029072 | A | 2/2011 |
| JP | 2012520543 | A | 9/2012 |
| WO | 0239792 | A2 | 5/2002 |
| WO | 2013020151 | A1 | 2/2013 |
| WO | 2013130525 | A1 | 9/2013 |
| WO | 2015034791 | A1 | 3/2015 |

* cited by examiner

X-RAY ANODE

BACKGROUND OF THE INVENTION

Field of the Invention

The present invention relates to an x-ray anode for generating x-radiation, comprising a carrier body and a first emission layer and at least one second emission layer, which generate x-radiation when they are impinged by electrons.

X-ray anodes are required in x-ray devices, such as for example in computed tomography scanners for medical diagnostics or in baggage x-ray machines. During the operation of an x-ray device, electrons emitted by a cathode are accelerated by a high voltage to the x-ray anode and penetrate into the anode material, whereby x-radiation is produced. A large part of the energy of the electron beam is in this case dissipated in the x-ray anode as heat, and as a result there are very high thermal loads in the focal region of the x-ray anode.

X-ray anodes are typically configured as a fixed component in the form of a stationary anode with a focal spot or as a rotating component in the form of a rotary anode with an annular focal track. X-ray anodes are also known to extend linearly, also known as linear anodes, with an elongate focal track. Linear anodes do not rotate and are usually configured as static anodes, which however can be moved for example for taking successive radiographs during a computed tomography scan.

X-ray anodes are usually constructed as a composite assembly made up of at least one carrier body, which provides the mechanical stability and is preferably formed from a high-melting material with a high thermal conductivity, and at least one emission layer, also referred to as a focal coating or focal track coating, in which x-radiation is generated when it is impinged by high-energy electrons. In the case of stationary anodes, this carrier body generally has a beveled cylindrical basic form, on the usually beveled front surface of which there is arranged a comparatively thin, disk-shaped focal coating of an x-ray-generating material, for example of tungsten or a tungsten alloy.

Rotary anodes usually have an annular focal coating of an x-ray-generating material as an emission layer on the surface of a disk-shaped carrier body. As a result of the rotational movement of the rotary x-ray anode, during use the focal coating is scanned by the electron beam at discrete points along an annular path, whereby the thermal load can be distributed better in the rotary anode.

Linear anodes have an elongate alignment, for example a bar-shaped basic form; an example of this is described in WO 2013/020151 A1. In the case of linear anodes, a focal coating of an elongate configuration is typically arranged on a side surface, not the front surface, of the elongate carrier body.

On account of the interaction with the high-energy electron beam and the high thermomechanical loads, which particularly in the case of rotary anodes occur in a cyclical manner, the lifetime of x-ray anodes is greatly restricted. As the x-ray anode is used more and more, the focal coating becomes fatigued, microcracks may occur in the focal coating and, with further loading, spread in the form of a network into the body of the x-ray anode. Instances of damage to the focal coating have disadvantageous consequences for the yield from the radiation dose and have adverse effects on the image quality of the radiographs. If the yield from the radiation dose goes below a critical threshold value, either the entire x-ray anode must be exchanged or at least the damaged focal coating must be reworked or renewed. To improve the used focal coating, it is known to remove the used focal coating down to a crack-free surface, which is not possible to an unlimited extent because of the restricted thickness of the focal track coating. The lifetime of the x-ray anode may also be extended by applying a new focal coating to the used focal coating, possibly after prior removal. However, this reconditioning process for the focal coating is extremely laborious and is accompanied by high costs. There is therefore a need in the industry for x-ray anodes that have a long lifetime.

SUMMARY OF THE INVENTION

The object of the present invention is to provide an x-ray anode that has an extended lifetime. This object is achieved by an x-ray anode as claimed. Advantageous developments of the invention are specified in the dependent claims.

The present invention proposes an x-ray anode for generating x-radiation that has a carrier body and a first emission layer and at least one second emission layer of x-radiation-emitting material, wherein the emission layers are separated by an intermediate layer on one side of the carrier body and are arranged a distance apart in a central direction of the x-ray anode. The first emission layer and at least one second emission layer are in this case arranged on the side of the x-ray anode that is facing the x-radiation-generating electron beam during operation of the x-ray anode, also referred to hereinafter as the focal track side. The central direction generally refers to a direction which is oriented perpendicularly to a plane that is defined substantially by the extent of the first emission layer. In the case of a rotary anode, the central direction corresponds in any event to the axis of rotation of the rotary anode. In the case of a stationary anode, in which the emission layer is typically formed as a compact disk, the central direction refers to the axial direction of the stationary anode. In the case of a linear anode, the plane defining the central direction corresponds to the focal track side of the linear anode, that is to say the, usually planar, side surface with the elongate emission layer that is facing the x-radiation-generating electron beam in the installed position of the x-ray anode.

The central idea of the present invention is that, apart from a first, active emission layer, which is arranged on an outer surface of the x-ray anode, the x-ray anode has at least one further, second emission layer, which is at first hidden in the interior of the carrier body, protected by an intermediate layer. As long as the first emission layer is used for generating x-radiation by interacting with high-energy electrons, the at least one second emission layer is protected from the impingement of electrons by a correspondingly dimension intermediate layer, and is therefore inactive. When the until then active first emission layer has been used up, and the yield needed from the x-ray dose can no longer be achieved, it can be removed along with the intermediate layer down to the surface of the until then inactive second emission layer. The exposed second emission layer then becomes the active emission layer, on which the electrons impinge during further operation of the x-ray tube and in which x-radiation is generated by interaction with the material of the x-ray anode. The x-ray anode according to the invention therefore does not have to be renewed until all of the emission layers have been worn away. Machining (grinding, turning on a lathe) allows the lifetime of the x-ray anode according to the invention to be extended significantly, approximately doubled in comparison with a conventionally constructed x-ray anode.

Apart from a single second emission layer, further second emission layers may be provided in the x-ray anode, the layers being respectively arranged a distance apart by an intermediate layer in the central direction and successively activatable, i.e. progressively exposed and used for generating x-radiation after the emission layer respectively lying thereover has been worn away. Depending on the number of emission layers, the average lifetime of such an x-ray anode can be a multiple of a conventional x-ray anode with only one emission layer.

For improved heat dissipation, the emission layers, the intermediate layer and the carrier body of the x-ray anode are preferably respectively connected to one another in a material-bonding manner. To protect the second emission layer, which is at first inactive, the distance from the inactive second layer to the surface of the x-ray anode in the central direction should be greater than the average depth of penetration of the electrons into the x-ray anode. The thickness of the intermediate layer, i.e. the distance in the central direction between two adjacent emission layers, is advantageously at least 0.5 mm, preferably at least 2 mm. This ensures that interaction of the electron beam with the at first inactive second emission layer, and consequently the risk of premature damage, is as small as possible. In order to keep down the weight of the x-ray anode, particularly in the case of rotary anodes the moment of inertia, it should be ensured that the intermediate layer is dimensioned to be not much thicker than required; the thickness is advantageously less than 10 mm, in particular less than 5 mm.

According to an advantageous development, the first emission layer and at least one second emission layer are arranged in such a way that the geometry and position of the respectively active emission layer does not alter significantly when the active emission layer is changed. Preferably, in a plan view of the focal track side, the first emission layer and the second emission layer are congruent in the central direction in a region of impingement of the electrons. The region of impingement of the electrons is taken to mean that region on the surface of the x-ray anode that is passed over by the electron beam during the operation of the x-ray anode. Advantageously, the distance between the first emission layer and the second emission layer is substantially constant in the region of impingement of the electrons. The congruent or parallel arrangement of the first emission layer and the second emission layer achieves the effect that the geometry of the active emission layer, and as a result the functionality of the x-ray anode, remains unchanged when an unused emission layer is exposed and becomes the active emission layer. It is therefore not necessary to alter the operating parameters, such as to carry out laborious repositioning of the x-ray anode or change the path of the electron beam. In order to compensate for the slightly smaller thickness of the x-ray anode after the removal of the used emission layer, a displaceability of the x-ray anode in the central direction may be provided in the x-ray device.

Materials that are known for generating x-radiation, such as in particular tungsten or tungsten alloys, in particular tungsten-rhenium alloys, come into consideration as materials for the emission layers. In order that the radiating characteristics of the x-ray anode do not alter when the emission layers are changed, the same material is preferably chosen for the first emission layer and the at least one second emission layer. The thickness of the emission layer is usually in the range from 0.2 to 2 mm.

Suitable materials for the carrier body are, in particular, molybdenum and molybdenum-based alloys (for example TZM, MHC), tungsten or tungsten-based alloys and also an alloy on the basis of copper. A molybdenum-based, tungsten-based or copper-based alloy refers to an alloy that comprises at least 50 atomic % molybdenum, tungsten or copper, in particular at least 90 atomic % molybdenum, tungsten or copper. TZM refers to a molybdenum alloy with a titanium component of 0.5% by weight, a zirconium component of 0.08% by weight, a carbon component of 0.01-0.04% by weight and otherwise made up of molybdenum (apart from impurities). MHC is understood in this connection as meaning a molybdenum alloy that has a hafnium component of 1.0 to 1.3% by weight, a carbon component of 0.05 to 0.12% by weight, an oxygen component of less than 0.06% by weight and is otherwise made up of molybdenum (apart from impurities). The carrier body may also comprise a tungsten-copper composite material, a copper composite material, a particle-reinforced copper alloy, a particle-reinforced aluminum alloy or graphite.

In an advantageous embodiment, the intermediate layer that separates the individual emission layers from one another is formed from the same material as the carrier body. Among the advantages this brings are production-related advantages. It also proves to be advantageous if the coefficient of thermal expansion of the material of the intermediate layer differs by no more than 35% from the coefficient of thermal expansion of the first emission layer or the second emission layer. In the x-ray anode, the active emission layer and the regions directly adjacent thereto are the regions of the x-ray anode that are subjected most to thermal loading. Excessive differences in the coefficient of thermal expansion would cause high mechanical stresses during operation, and these can have an adverse effect on the lifetime of the x-ray anode.

In a simple variant, the intermediate layer may be constructed homogeneously, but it may also be structured in various functional intermediate layers.

The intermediate layer may for example have at least one barrier layer. Such a barrier layer may be formed as a diffusion barrier layer to suppress diffusion, for example undesired carbon diffusion into the emission layer, and for this purpose be formed from rhenium, molybdenum, tantalum, niobium, zirconium, titanium or compounds or alloys of these metals or combinations of these metals.

The barrier layer may be designed as a barrier against the spread of cracks that occur in the active emission layer during the operation of the x-ray anode due to the interaction with high-energy electrons. In particular, such a barrier layer helps to stop the propagation of these cracks or the formation of a crack network into the still unused second emission layer. A barrier layer designed for crack suppression may for example consist of tantalum, niobium or rhenium. Generally, when choosing the material for the intermediate layer, or individual layers of the intermediate layer that are directly adjacent to the emission layer, it should be ensured that no disturbing diffusion of the material of the intermediate layer itself into the first or second emission layer takes place.

The intermediate layer may have at least one binding layer, which improves the binding attachment of the emission layer. Such a binding layer may preferably be enriched with the constituents of the emission layer, such as for example with tungsten or rhenium, or a compound thereof.

The idea of providing an x-ray anode with additional, initially inactive and progressively activatable emission layers can be applied to x-ray anodes of the widest variety of forms of construction. In particular, the x-ray anode according to the invention may be configured as a stationary anode or as a linear anode.

Particularly preferably, the x-ray anode may be configured as a rotary anode. Advantageously, the first emission layer and the second emission layer may in this case be formed in an annular manner and be arranged one above the other in the central direction. Rotary anodes have a relatively high basic price, and it is therefore economically worthwhile, particularly in the case of rotary anodes, to repair the emission layer when it is worn away instead of replacing the entire rotary anode. The rotary anode according to the invention has the advantage over a repaired rotary anode that the second emission layer is still untouched when it finally comes to be used.

For producing the x-ray anode according to the invention, it is possible to rely on the production processes for x-ray anodes that have been tried and tested in the prior art. The emission layers and the intermediate layer may be produced as a laminate by means of powder-metallurgical processes, by pressing, sintering and forging correspondingly layered powders or powder mixtures. In the case of metallic materials for the carrier body with a high melting point, such as for example TZM or MHC, the emission layers and the intermediate layer are preferably produced together with the carrier body. For this purpose, in a first step a pressed blank is produced from the correspondingly layered powder or powder mixture, by the powder or the powder mixture for the carrier body being introduced into a pressing mold and pressed, subsequently the powder or the powder mixture for the second emission layer is applied and pressed, in a next step the powder or the powder mixture for the intermediate layer is applied and pressed and finally the powder or the powder mixture for the first emission layer is applied and pressed. Subsequently, the pressed blank obtained in this way is sintered, forged and remachined in a known way. In the case of metallic materials for the carrier body with a comparatively low melting point, such as for example copper, a powder-metallurgically produced laminate comprising emission layers and an intermediate layer can be laminated together with a melt of the carrier body material. If graphite is used as the material for the carrier body, it is difficult for the carrier body to be connected reliably to a laminate with the emission layers that has been powder-metallurgically produced independently. In particular, in this case the emission layers and the intermediate layer may be applied to the carrier body by known coating processes, such as for example chemical vapor phase deposition, physical vapor phase deposition or thermal coating processes such as in particular plasma spraying.

The invention is described in more detail in the description that follows of three exemplary embodiments with reference to the accompanying figures.

BRIEF DESCRIPTION OF THE SEVERAL VIEWS OF THE DRAWING

There is shown in a representation that is not to scale.

DESCRIPTION OF THE INVENTION

Figure 1:
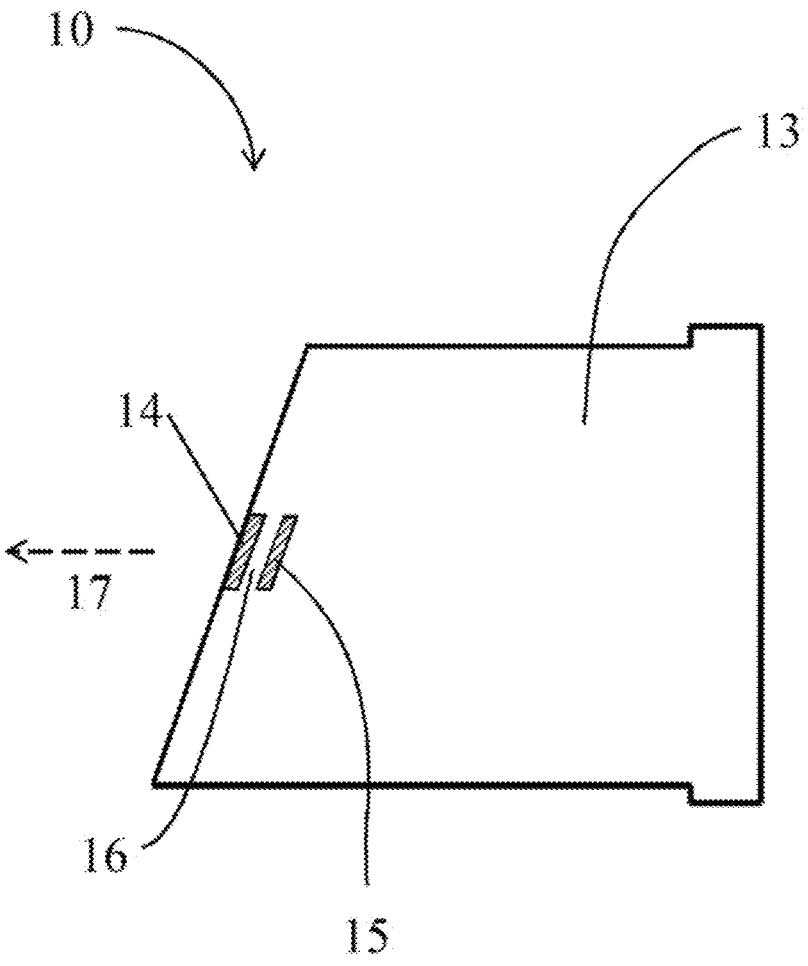
FIG. 1: a sectional representation of a stationary anode.

FIG. 1 shows a schematic sectional representation of a stationary anode 10, the basic construction of which is known in the prior art. In a known way, arranged on a substantially cylindrical carrier body 13, on its beveled front side that is facing the electron beam during operation, is a first emission layer 14, to which high-energy electrons are accelerated during operation, x-radiation being generated in interaction with the material of the emission layer. The stationary anode according to the invention differs from the prior art by a second emission layer 15, which is in the interior of the stationary anode and is arranged at a distance in the central direction 17 from the first emission layer. The central direction 17 corresponds to the axial direction of the stationary anode 10. The intermediate layer 16 separates the two emission layers 14, 15 and protects the at first inactive second emission layer 15 from the electrons impinging on the first emission layer. When the first emission layer 14 is no longer suitable for further operation, the second emission layer 15 is exposed and comes to be used for generating x-radiation. Therefore, the stationary anode according to the invention can still be used after the first emission layer has worn away, and only has to be reworked or renewed when both emission layers are unusable. The stationary anode 10 according to the invention therefore has a lifetime that is approximately twice as long as a stationary anode of the prior art. The geometry and position of the second emission layer 15 are preferably adapted to those of the first emission layer 14, so that, when the emission layer is changed, apart from a displacement in the central direction the stationary anode does not have to be laboriously readjusted. The first emission layer 14 and the second emission layer 15 are parallel to one another and are congruent in the viewing direction along the central direction 17.

Figure 2:
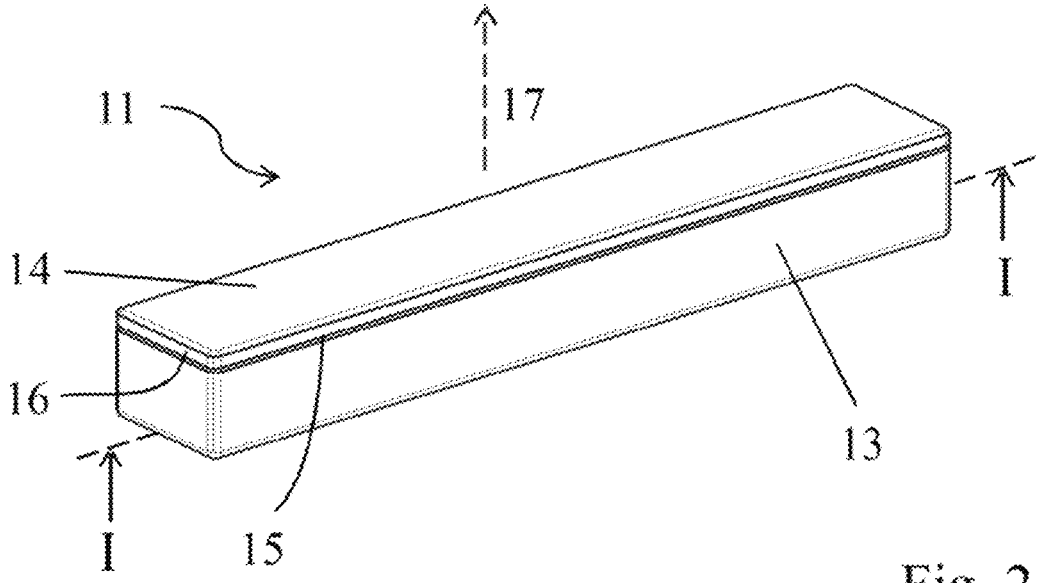
FIG. 2: a perspective representation of a linear anode.
Figure 3:
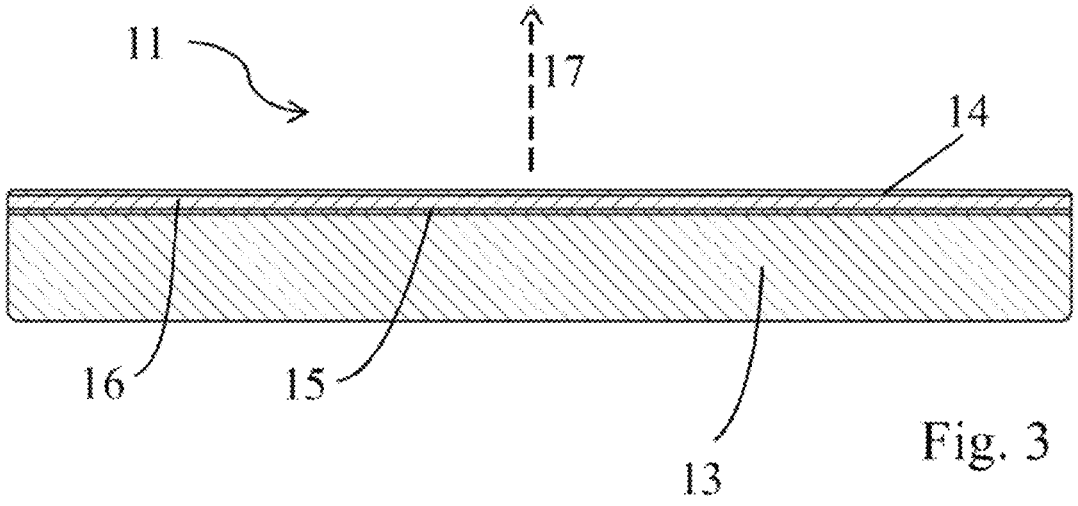
FIG. 3: a sectional representation of the linear anode from FIG. 2 along the sectional plane I-I.

FIG. 2 and FIG. 3 show the application of the idea according to the invention to a linear anode 11. An example of a linear anode of the prior art is described in WO 2013/020151 A1. Linear anodes have an elongated extent along one direction of extent, in the present exemplary embodiment a bar-shaped basic form, wherein the main direction of extent of the anode does not necessarily have to run along a straight line but may also go along a curved line. This means that even a cuboid that has a curvature at least over part of its profile should be understood within the scope of the present invention as a linear anode. The first emission layer 14 and the second emission layer 15 are arranged on the side surface of the cuboidal carrier body that is facing the electron beam during operation. The first emission layer 14 is of an elongate configuration and defines a plane that is perpendicular to the central direction 17. The first emission layer 14 and the second emission layer 15 are arranged a distance apart in the central direction 17, separated by an intermediate layer 16. The distance between the two emission layers 14, 15 is constant over the surface-area extent of the emission layer. Preferably, the first emission layer 14 and the second emission layer 15 are congruent in the viewing direction along the central direction 17. By analogy with the stationary anode, the second emission layer 15 only comes to be used when the necessary yield from the x-ray dose can no longer be achieved with the first emission layer 14 and the first emission layer 14 and the intermediate layer 16 have been ground away to allow the linear anode to be used further.

Figure 4:
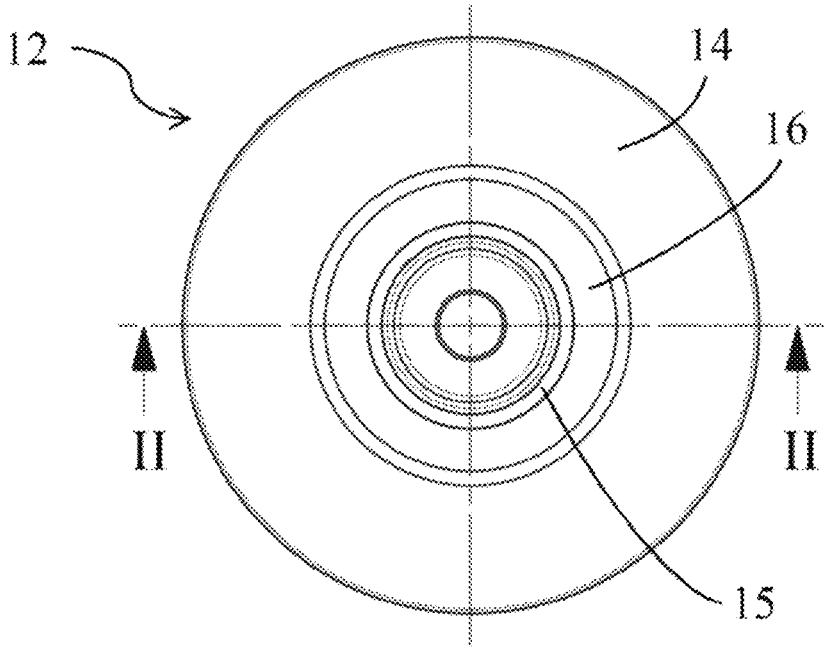
FIG. 4: a plan view of a rotary anode.
Figure 5:
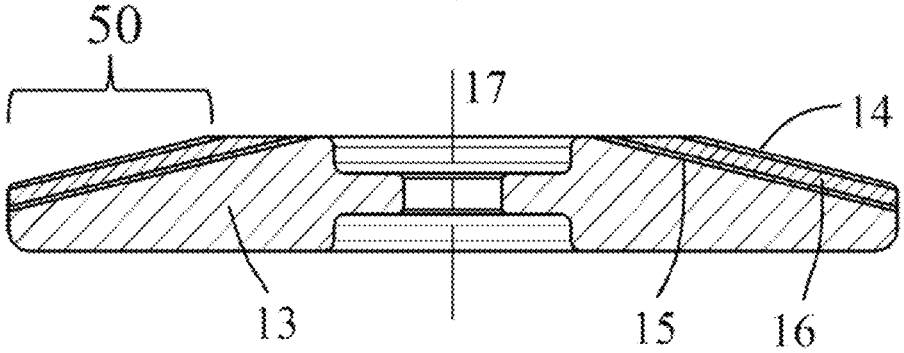
FIG. 5: a sectional representation of the rotary anode from FIG. 4 along the sectional plane II-II.
Figure 6:
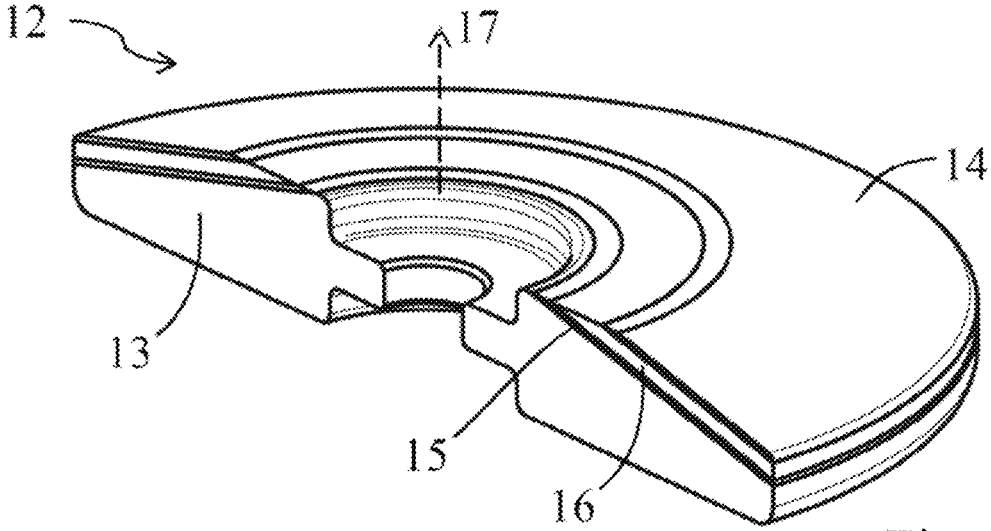
FIG. 6: an axonometric view of the rotary anode from FIG. 4.

In FIGS. 4 to 6, a rotary anode 12 according to the invention with a plate-shaped, rotationally symmetrical carrier body 13 is schematically represented. As in the case of rotary anodes known in the prior art, on the side that is facing the electron beam during operation, a first emission layer 14 is arranged in an annular region at the beveled shoulders of the carrier body. This region corresponds to the region of impingement 50 of the electrons during the operation of the rotary anode. By analogy with the previous embodiments, the rotary anode 12 according to the invention has apart from a first emission layer 14 a second emission layer 15, which is arranged a distance apart in the central direction 17, separated by an intermediate layer 16. The central direction 17 is given by the direction of the axis of rotation of the rotary anode. In the present exemplary embodiment, the second emission layer 15 extends beyond the region of impingement 50 of the electrons into an inner region. As explained below, there are powder-metallurgical production-related reasons for this, but it is clearly not absolutely necessary. When the first emission layer 14 is no longer suitable for further use, it and the intermediate layer 16 are removed. Preferably, during the grinding or turning on a lathe of the rotary anode, that part of the second emission layer 15 that is located in the inner region, that is to say outside the region over which the first emission layer extends, is also removed. The second emission layer 15, as the active emission layer, then has the same extent as the first emission layer 14. The first emission layer 14 and the second emission layer 15 are arranged parallel to one another and, in the case of the present rotary anode, the two emission layers 14, 15 are congruent in a viewing direction along the central direction 17 in the region of impingement 50 of the electrons. The geometry of the two emission layers 14, 15 is therefore made to match one another, in order that, apart from a displacement in the central direction, no further adaptations of the rotary anode are necessary when the active emission layer is changed. Preferably, the material of the first emission layer 14 and the second emission layer 15 is also made to match one another and the same material is used for the two emission layers 14, 15, so that the emitted radiation spectrum of the x-ray anode also does not alter when the active emission layer is changed.

During the operation of the rotary anode, the intermediate layer 16 protects the at first inactive second emission layer 15 from the impinging electrons and should be dimensioned with sufficient thickness in order that no instances of premature damage due to interaction with impinging electrons occur. A distance (in the central direction) between the two emission layers of between 2 and 5 mm has proven to be advantageous, since as a result on the one hand sufficient protection under the commonly occurring loads could be ensured, on the other hand the moment of inertia of the rotary anode is not significantly increased by the additional mass. In order to ensure good onward heat conduction, the first emission layer is connected to the intermediate layer in a material-bonding manner, and the second emission layer is connected to the intermediate layer and to the carrier body in a material-bonding manner. It also proves to be an advantage if the intermediate layer represents a barrier against the further spread of cracks, such as are produced in the active emission layer. The intermediate layer 16 may also form a barrier against the diffusion of harmful substances into the emission layers (for example of carbon from the commonly used carrier body material TZM or MHC). It is also advantageous if the intermediate layer 16 improves the binding attachment of the emission layer to the carrier body. The intermediate layer 16 may for this purpose be made up of a number of different layers with differing functionality, in particular of a barrier layer and/or a binding layer.

Figure 7:
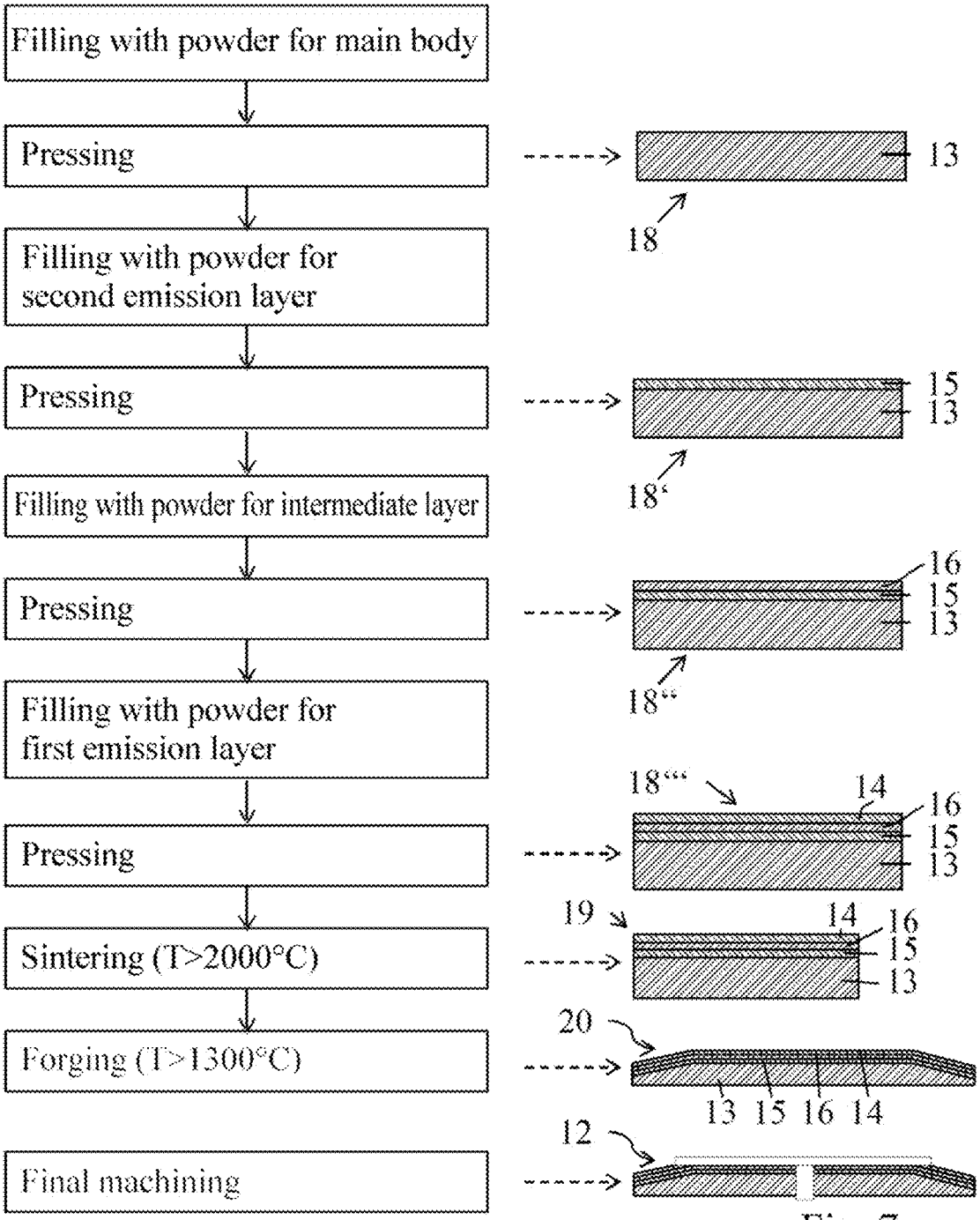
FIG. 7: a flow diagram of a powder-metallurgical process for producing a rotary anode.

FIG. 7 shows on the left the flow diagram for a powder-metallurgical process for producing an x-ray anode according to the invention, in particular a rotary anode. The production process according to the invention is primarily suitable for the production of a metallic carrier body from a refractory metal or from an alloy on the basis of a refractory metal such as TZM or MHC and comprises at least the following steps:

- filling a pressing mold with a powder or a powder mixture for the carrier body
- pressing the powder or the powder mixture to form a molding
- applying the powder or the powder mixture for the second emission layer to the molding obtained in the previous step
- pressing the component obtained in the previous step to form a molding
- applying the powder or the powder mixture for the material of the intermediate layer to the molding obtained in the previous step
- pressing the component obtained in the previous step to form a molding
- applying the powder or the powder mixture for the first emission layer to the molding obtained in the previous step
- pressing the component obtained in the previous step to form a molding
- sintering the molding at temperatures greater than 2000° C.
- forging the sintered molding at temperatures greater than 1300° C.
- optionally final machining to form an x-ray anode, in particular a rotary anode.

Schematically indicated on the right in FIG. 7 are the intermediate products produced in individual steps of the process and the final product in the example of a rotary anode. In this case, the pressing blank is denoted by 18,18', 18",18'", the sintered blank by 19, the forging blank by 20 and the finished rotary anode by 12.

Figure 8A:
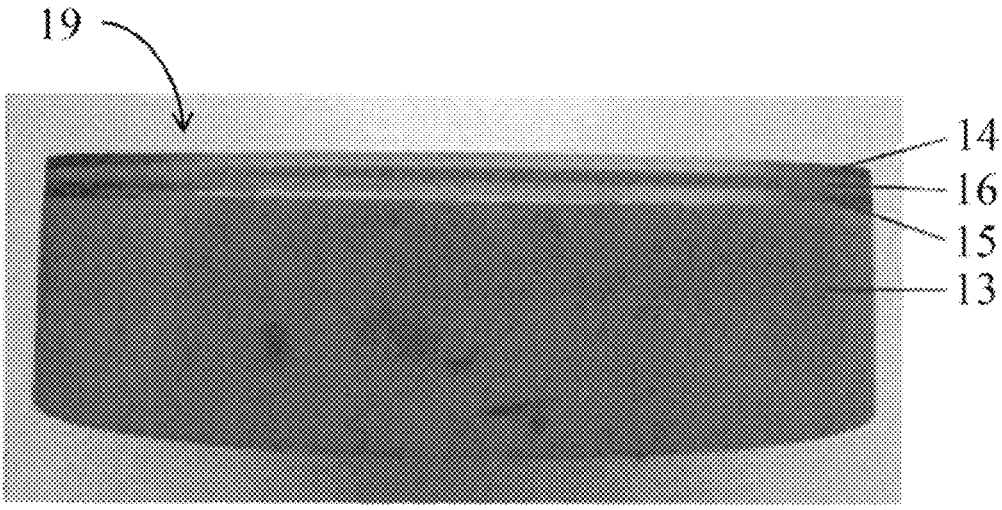
FIG. 8*a*: a side view of a sintered component.
Figure 8B:
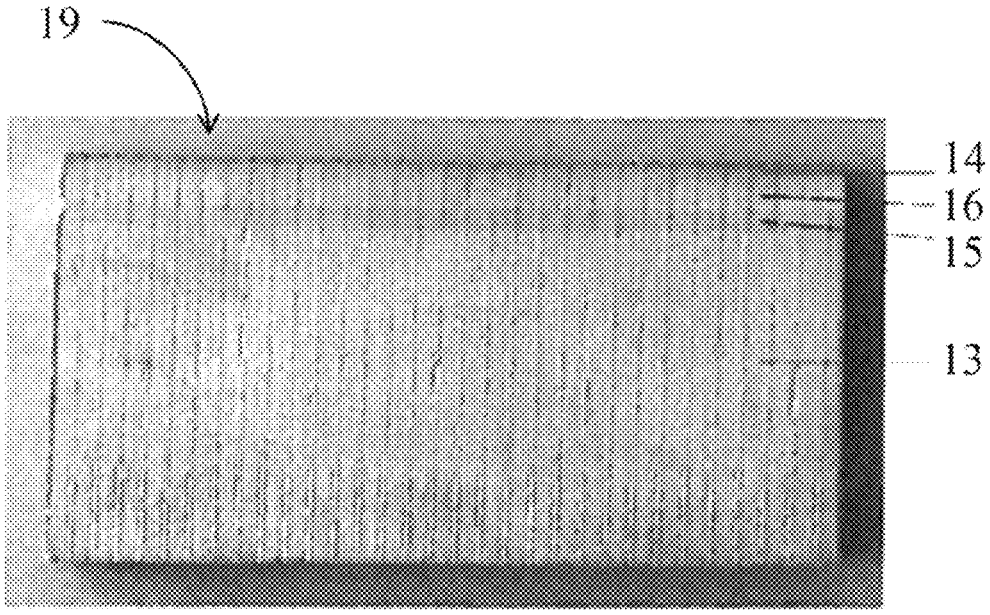
FIG. 8*b*: a section through the sintered component from FIG. 8*a;*
Figure 9A:
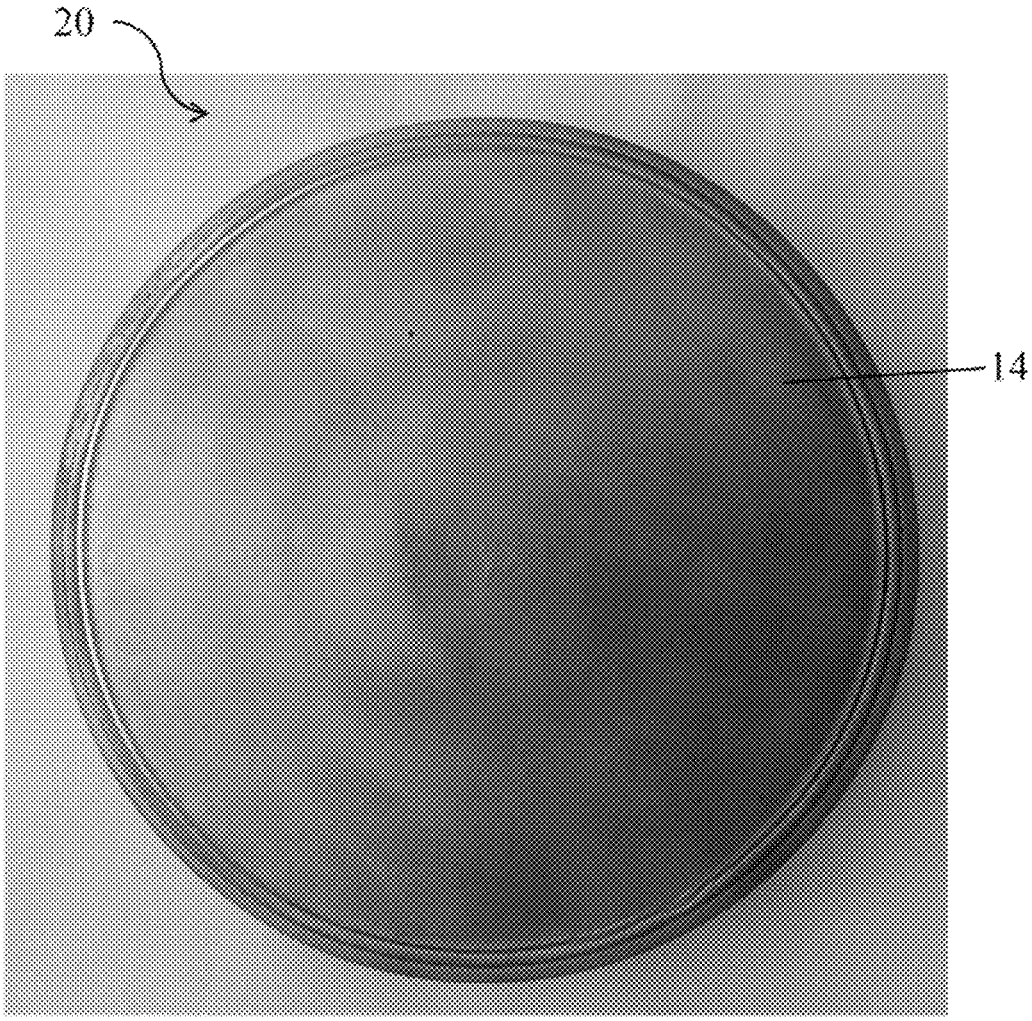
FIG. 9*a*: a plan view of a forging blank.
Figure 9B:
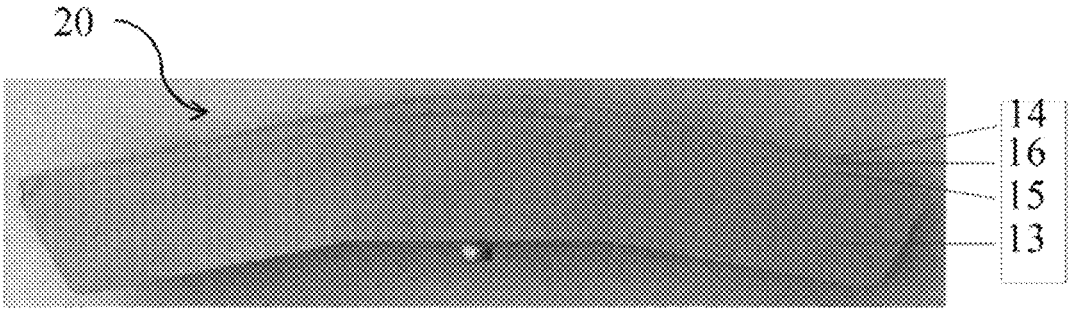
FIG. 9*b*: a section through the forging blank from FIG. 9*a*.

FIG. 8*a*, FIG. 8*b*, FIG. 9*a* and FIG. 9*b* show some of these intermediate products on the basis of a specific exemplary embodiment in which a TZM powder is used as initial powder for the carrier body and a W95Re5 powder is used for the two emission layers. The powders were layered in a way corresponding to process steps previously described, pressed at pressures of up to 50 kN/cm$^2$ and subsequently sintered at a temperature of about 2000° C. to 2400° C. The sintered component 19 thus obtained is represented in FIG. 8*a* in a side view and in FIG. 8*b* in a sectional side view. Subsequently, the sintered component was forged in an impact bonding press at temperatures above 1300° C. to form a component with hanging shoulders. The forging blank 20 is depicted in FIG. 9*a* in a plan view from above and in FIG. 9*b* in a sectional representation. In the case of these prototypes, for production-related reasons the emission layers 14, 15 extend over the entire extent of the component, but for mass production it may of course be provided that the powder for the emission layers is only applied in the ultimately required region at the hanging shoulders. The forging blank is subsequently remachined, including that the first emission layer is ground away in the inner region that is not required. To increase the heat radiating capability, a radiating body may be arranged (in a known way) on the side of the rotary anode that is opposite from the focal track side.

The invention claimed is:

1. An x-ray anode for generating x-radiation, the x-ray anode comprising:

a carrier body;

a first emission layer arranged on an outer surface of the x-ray anode, and at least one second emission layer hidden in an interior of said carrier body, said first emission layer and said second emission layer both configured to generate x-radiation upon being impinged by electrons, said first emission layer and said second emission layer arranged on one side of said carrier body; and an intermediate layer disposed to separate said first and second emission layers from one another, and said first and second emission layers being disposed at a spacing distance from one another in a central direction of the x-ray anode;

said spacing distance between said first and second emission layers in the central direction is at least 0.5 mm such that said first emission layer is used for generating x-radiation by interacting with high-energy electrons and said second emission layer is protected from the impingement of electrons by the intermediate layer and is therefore inactive.

2. The x-ray anode according to claim 1, wherein said first emission layer and said at least one second emission layer are congruent in a viewing direction along the central direction in a region of impingement of the electrons.

3. The x-ray anode according to claim 1, wherein, at least in certain portions, the spacing distance between said first emission layer and said second emission layer is substantially constant.

4. The x-ray anode according to claim 1, wherein at least one of said first emission layer and said second emission layer is formed of a material selected from the group consisting of tungsten, rhenium and a tungsten alloy.

5. The x-ray anode according to claim 4, wherein at least one of said first emission layer and said second emission layer is formed of a tungsten-rhenium alloy.

6. The x-ray anode according to claim 1, wherein said first emission layer and said at least one second emission layer are formed of a common material.

7. The x-ray anode according to claim 1, wherein said intermediate layer between said first and second emission layers is formed of a same material as said carrier body.

8. The x-ray anode according to claim 1, wherein said intermediate layer between said first and second emission layers comprises at least one material selected from the group consisting of molybdenum, tungsten, copper, an alloy based on tungsten, an alloy based on molybdenum, an alloy based on copper, a tungsten-copper composite material, a copper composite material, a particle-reinforced copper alloy, a particle-reinforced aluminum alloy and graphite.

9. The x-ray anode according to claim 1, wherein said carrier body comprises at least one material selected from the group consisting of molybdenum, tungsten, copper, an alloy based on tungsten, an alloy based on molybdenum, an alloy based on copper, a tungsten-copper composite material, a copper composite material, a particle-reinforced copper alloy, a particle-reinforced aluminum alloy and graphite.

10. The x-ray anode according to claim 1, wherein said intermediate layer is one of a plurality of intermediate layers.

11. The x-ray anode according to claim 1, wherein said intermediate layer comprises at least one barrier layer.

12. The x-ray anode according to claim 1, wherein said intermediate layer comprises at least one binding layer.

13. The x-ray anode according to claim 1, wherein the x-ray anode is configured as a stationary anode or a linear anode.

14. The x-ray anode according to claim 1, wherein the x-ray anode is configured as a rotary anode.

15. The x-ray anode according to claim 14, wherein said first emission layer and said at least one second emission layer are annular layers arranged one above another in the central direction.

* * * * *